US006622908B2

(12) United States Patent
Fukumoto et al.

(10) Patent No.: US 6,622,908 B2
(45) Date of Patent: Sep. 23, 2003

(54) PUNCH MACHINE

(75) Inventors: Hiroshi Fukumoto, Kaga (JP); Masanori Taga, Fukui-ken (JP)

(73) Assignee: Daido-Kogyo Kabushiki Kaisha (JP)

( * ) Notice: Subject to any disclaimer, the term of this patent is extended or adjusted under 35 U.S.C. 154(b) by 174 days.

(21) Appl. No.: 09/766,243

(22) Filed: Jan. 19, 2001

(65) Prior Publication Data

US 2001/0011492 A1 Aug. 9, 2001

(30) Foreign Application Priority Data

Jan. 19, 2000 (JP) ..... 2000/011014

(51) Int. Cl.[7] ..... B26F 1/04; B26F 1/14

(52) U.S. Cl. ..... 234/98; 83/549; 83/687

(58) Field of Search ..... 234/42, 98, 43, 234/97, 94, 101, 106; 83/629, 638, 687, 618, 619, 620, 622, 628, 588, 821, 549

(56) References Cited

U.S. PATENT DOCUMENTS

| | | | | | |
|---|---|---|---|---|---|
| 46,279 | A | * | 2/1865 | Stone | 83/468.9 |
| 260,381 | A | * | 7/1882 | Foglesong | 83/558 |
| 647,272 | A | * | 4/1900 | Mendenhall | 83/468.9 |
| 756,902 | A | * | 4/1904 | Shoemaker | 83/588 |
| 1,060,772 | A | * | 5/1913 | Lenihan | 83/626 |
| 1,311,544 | A | * | 7/1919 | Williams | 234/94 |
| 1,383,673 | A | * | 7/1921 | Thomas | 83/145 |
| 1,747,240 | A | * | 2/1930 | Haupt | 83/354 |
| 2,034,341 | A | * | 3/1936 | Gregory et al. | 234/106 |
| 2,185,685 | A | * | 1/1940 | Blakely | 234/87 |
| 2,204,957 | A | * | 6/1940 | Carpenter et al. | 234/25 |
| 2,278,288 | A | * | 3/1942 | Sadler | 83/620 |
| 2,327,646 | A | * | 8/1943 | Hutchinson | 83/550 |
| 2,375,293 | A | * | 5/1945 | Doty | 234/28 |
| 2,397,605 | A | * | 4/1946 | Holden | 234/106 |
| 2,458,160 | A | * | 1/1949 | Grappe | 83/618 |
| 2,599,213 | A | * | 6/1952 | Velghe | 234/106 |
| 2,858,884 | A | * | 11/1958 | Duffield | 83/620 |
| 3,170,622 | A | * | 2/1965 | Lord | 234/106 |
| 3,334,809 | A | * | 8/1967 | Zajic et al. | 234/106 |
| 3,750,502 | A | * | 8/1973 | Ball | 83/620 |
| 4,480,782 | A | * | 11/1984 | Morishima | 234/98 |
| 4,898,056 | A | * | 2/1990 | Grobb et al. | 83/622 |
| 5,463,922 | A | * | 11/1995 | Mori | 83/622 |
| 5,894,778 | A | * | 4/1999 | Mori | 83/629 |
| 6,223,636 | B1 | * | 5/2001 | LaPlante et al. | 83/619 |
| 6,269,721 | B1 | * | 8/2001 | Tseng | 83/618 |
| 6,374,715 | B1 | * | 4/2002 | Takatsuka | 83/620 |

* cited by examiner

*Primary Examiner*—Allan N. Shoap
*Assistant Examiner*—Jason Prone
(74) *Attorney, Agent, or Firm*—Richard P. Gilly, Esquire; Wolf, Block, Schorr and Solis-Cohen, LLP

(57) ABSTRACT

Punch machine 30 has a plurality of punches 52, 53 and dies 54, 61 for punching a hole out of a sheet, a driving means 35 for reciprocating in a direction intersecting with respect to the punch by the driving force of driving source 33, and cam mechanisms 44, 84, 94, 62, 69 for changing the motion of the driving means into the movement direction of the punch so as to transmit to the punch between the punch and the driving means. A plurality of punches are divided into first group and second group. The cam mechanism provided between each punch of the first group and the driving means moves each punch 52 by the motion operation of the driving means in a first direction, and the cam mechanism provided between each punch of the second group and the driving means moves each punch 53 by the motion operation of the driving means in a second direction. Different pattern of punching is respectively possible by the first and second groups of punches.

10 Claims, 13 Drawing Sheets

PUNCH MACHINE

BACKGROUND OF THE INVENTION

This invention relates to punch machine for punching a hole out of material to be punched, such as a sheet by engaging a punch and a die with each other, and relates to punch machine equipped with a copying machine, a printer, a facsimile machine and a main body of an image forming unit of apparatus combining these machines, or a printing machine, for instance.

As shown in FIG. 13, in this kind of conventional punch machine, a pair of decentering cams 23, 23 are unitedly provided with a rotating shaft 22 rotating by a motor 21, and both ends of a punch holding member 25 having predetermined number of punches, for instance three punches 24, are supported by a pair of decentering cams 23, 23.

When the decentering cams 23, 23 are rotated, the punch 24 goes up and down by guiding by a guide hole 26. On this occasion, the punch 24 is inserted in and engaged with the die 27 so as to punch a hole out of sheet P, which is stopping material to be punched, such as paper.

The going up and down distance of the punch 24 of the conventional punch machine 20 is set rather long in comparison with thickness of a sheet. This distance is extremely shorter than the length of a sheet.

For this reason, when the punch 24 of the conventional punch machine 20 is continuously moved up and down, the punch may descend again before taking the sheet already punched out of the punch machine 20. So, there is a danger of punching the same sheet again. Therefore, the punch 24 is stopped at a waiting position away from a sheet until the sheet is taken out after punching a hole out of the sheet and a next sheet is set.

And, the punch 24 is provided with punch holding member 25, going up and down by transmitting the rotational force of the motor 21 to the decentering cams 23 through reducing gear mechanism 28 and the rotating shaft 22. Then, even if a motor 21 is stopped so as to try to stop the punch 24 at the utmost upper position, it is difficult to stop the punch 24 at the utmost upper position by inertia force, such as the motor 21 and the punch holding member 25.

Besides, when the motor 21 is rotated at high speed so as to move the punch 24 up and down at high speed in order to improve machining efficiency of punching machining, the inertia force becomes to be further bigger. Then, it is much difficult to correctly stop the punch 24 at the utmost upper position.

Furthermore, the conventional punch machine 20 has the structure that the position and the number of the punches 24 can not be changed. Then, the position and the number of the hole to be punched out of a sheet can not be changed.

OBJECT OF THE INVENTION

The object of the present invention is to provide punch machine wherein the punches can be certainly waited at waiting positions so as not to give the punches the influence of the inertia force of the rotating driving means for moving the punch even if the punches are moved at high speed, and the position and number of holes to be punched out of a sheet can be changed.

SUMMARY OF THE INVENTION

A punch machine comprises a plurality of punches and dies for punching holes out of material. Driving means for reciprocating in first and second directions intersecting with respect to the punches by a driving force of a driving source is provided. The punch machine also has a cam mechanism for changing the reciprocating motion of the driving direction into a direction moving the punch and transmitting it to the punch; the cam mechanism is provided between each punch and the driving means.

The plurality of punches is divided into a first group and a second group. The cam mechanism is located between each punch of the first group and the driving means. The cam mechanism moves each punch by movement operation of the driving means in the first direction. The cam mechanism located between each punch of the second group and the driving means moves each punch by movement operation of the driving means in the second direction.

When the driving means is actuated, the motion of the driving means is changed into the moving direction of the punch by the cam mechanism. As a result, the punch punches a hole out of a sheet while advancing it into the die. In this case, the first group of the punch punches a hole out of the sheet and the second group of the punch punches a hole out of the sheet when the driving means is moved in the first and second directions, respectively.

Because the first group of the punch and the second group of the punch are located at positions different from each other, the positions of the holes to be punched out of the sheet by the first and second groups are also different from each other; the position of the holes to be punched out of a sheet can be changed by the movement direction of the driving means. The number of the holes to be punched out of a sheet also can be changed if the number of punches of the first group and the second group differ. Therefore, the punch machine of the present invention is a single machine that performs the functions of two machines.

The punch machine can prevent the punch from driving in the direction of the material to be punched even if the driving means overruns by the influence of inertia by driving the punch through use of the cam mechanism. The position of the punch can be easily controlled without greatly affecting the accuracy and positioning of the driving source.

Optionally, the punch machine can have a cam mechanism that has a cam slot and a cam-follower engaging with the cam slot. Energizing means, for energizing the punch in a direction approaching the material to be punched, can also be provided with the punch.

The punch machine may incorporate a cam mechanism so that each punch moves with a predetermined phase difference among the punches comprising each group.

The punch machine may also incorporate driving means having a plate member being free to reciprocate and drive by the driving source, wherein the cam slot is formed on the plate member, and the cam-follower is provided with the punch. In this structure, the cam slot can be easily formed, corresponding to each punch, and the driving mechanism can be made simple.

The punch machine may incorporate driving means having a plate member being free to reciprocate and drive by the driving source, wherein the cam follower is formed on the plate member, and the cam slot may be formed on the punch side.

The punch machine may incorporate driving means having a belt member being free to reciprocate and drive by the driving source and a plurality of cam cylinders for reciprocally rotating and driving in predetermined angular bounds by the belt member; the cam cylinders are respectively provided, corresponding to each punch, and the cam mechanism is provided between the cam cylinder and the punch. Because the flexible belt member can be used as the driving means, the freedom of the arrangement of the driving source and the punches is increased and functional design is possible.

The punch machine may incorporate cam mechanisms provided for respective punches. By providing the cam mechanism for each punch, independent motion can be added to each punch and the complex motion patterns of the punch can be actualized. Additionally, the punch machine provides for a cam mechanism to be used for two or more punches.

The structure can be made simple by using the cam mechanism. For example, the arrangement interval among the punches can be made narrower and a punch arrangement having various intervals can be obtained.

The punch machine may also incorporate driving means having a plate member comprised of a single plate member; the plate member can be free to reciprocate and drive by the driving source, and the cam mechanism can be respectively provided between the plate member and the punch. All of the punches can be reciprocated and driven through the plate member by reciprocating the plate member. Additionally, all of the punches can be driven with a single plate member, and the mechanism for driving the punches can be made simple and small.

The punch machine may provide for the cam mechanism having a cam slot, engaging with a plurality of the cam-followers. By using the cam mechanism, the structure of the cam mechanism can be made simple. Additionally, the arrangement interval among the punches can be made narrower and a punch arrangement having various intervals can be obtained.

The punch machine may have means for holding the driving means. This results in the driving means being capable of being held at a predetermined position of the reciprocating motion.

The punch machine may incorporate a different number of the punches for the first and second groups. Thus, the punching operation is possible by combining various numbers of holes.

The punch machine may also have a plurality of punches belonging to the first group, a plurality of punches belonging to the second group, and the arrangement pitch for the first and second groups being different from each other. The punching operation is thus possible by combining holes having a plurality of various pitches.

Figure 6:
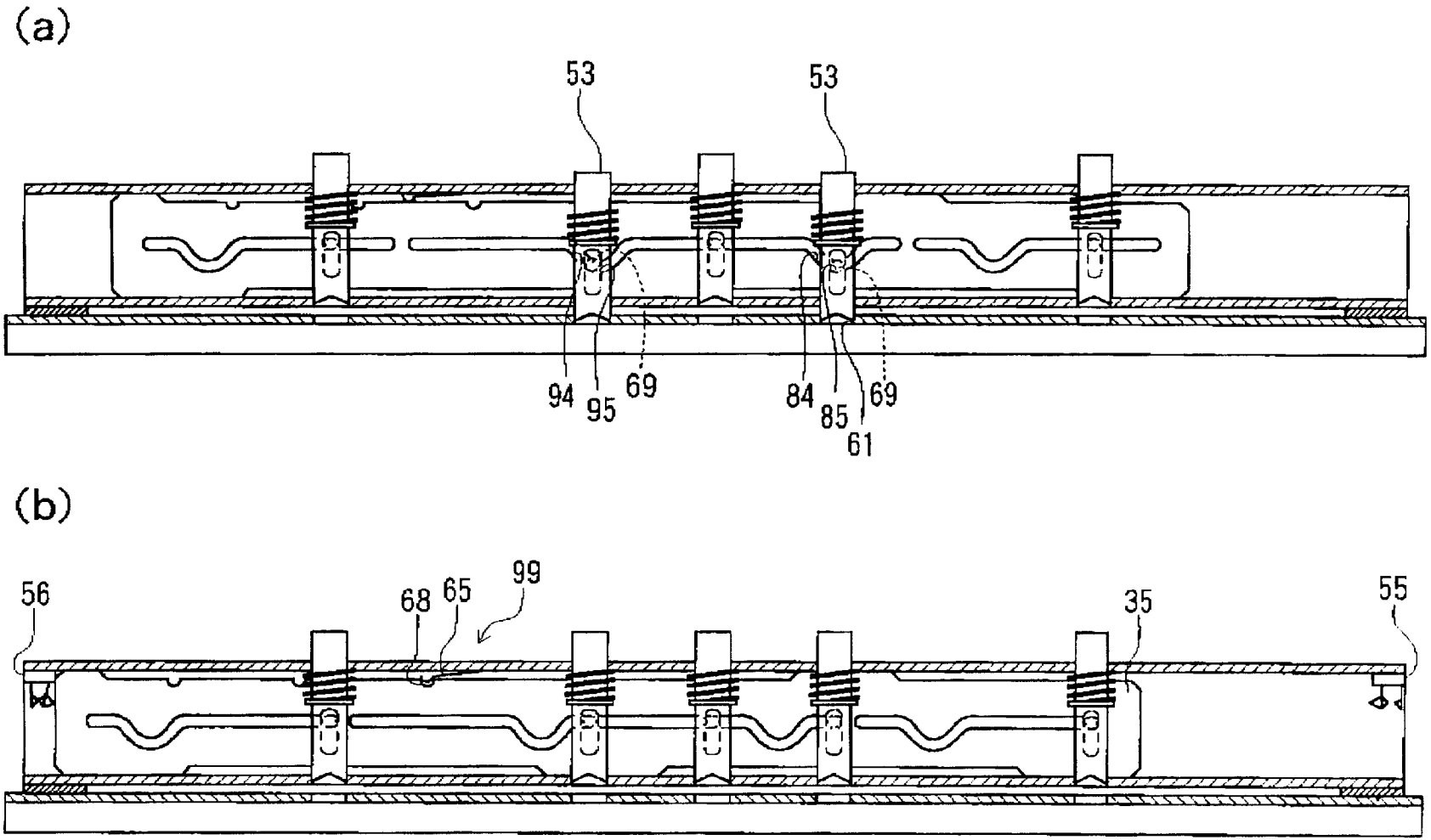
Figure 7:
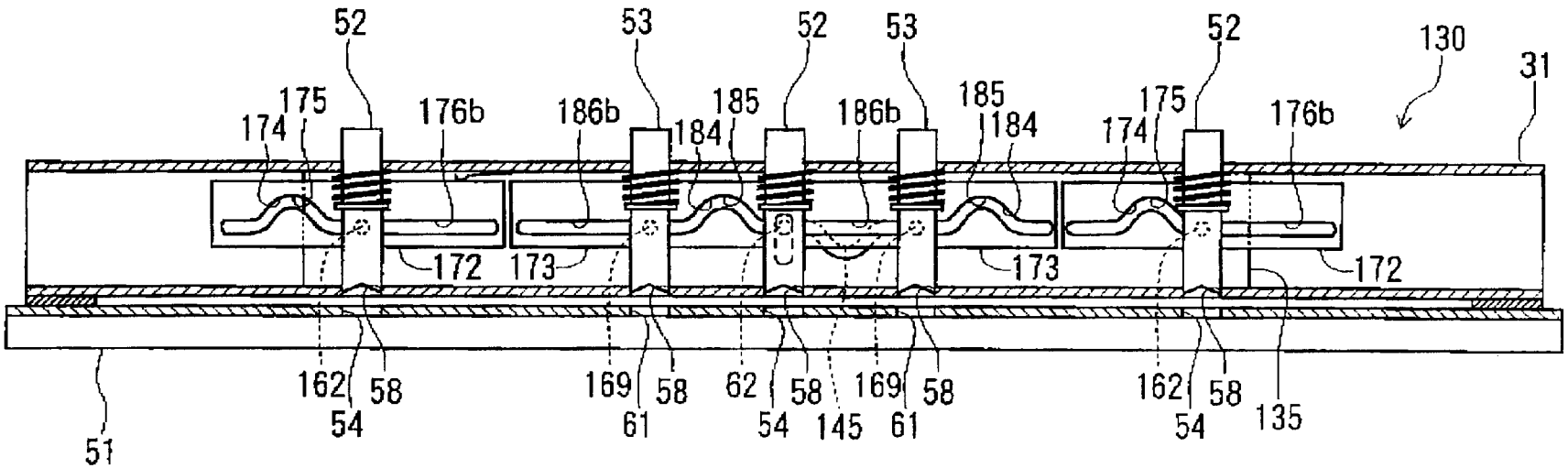
Figure 8:
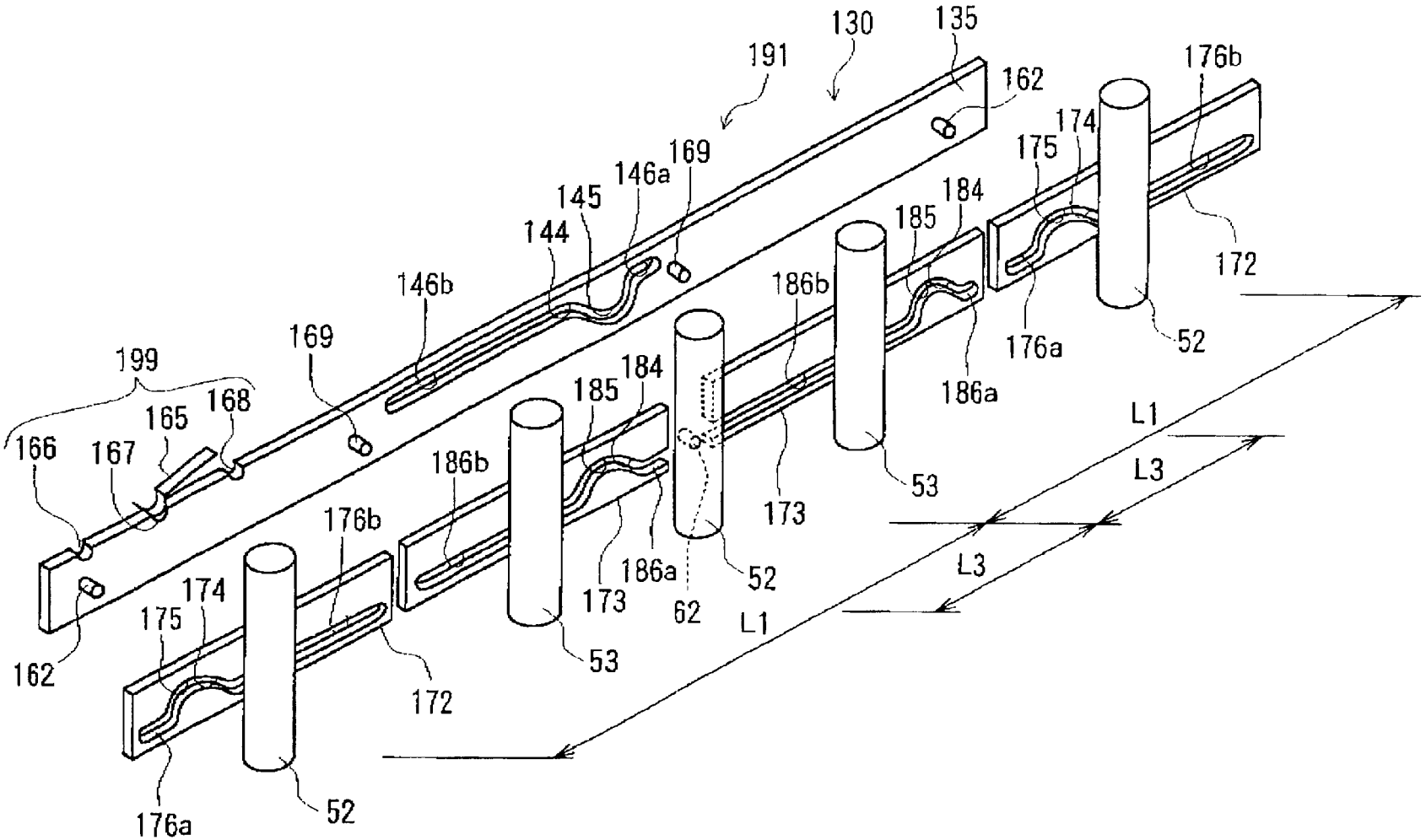
Figure 9:
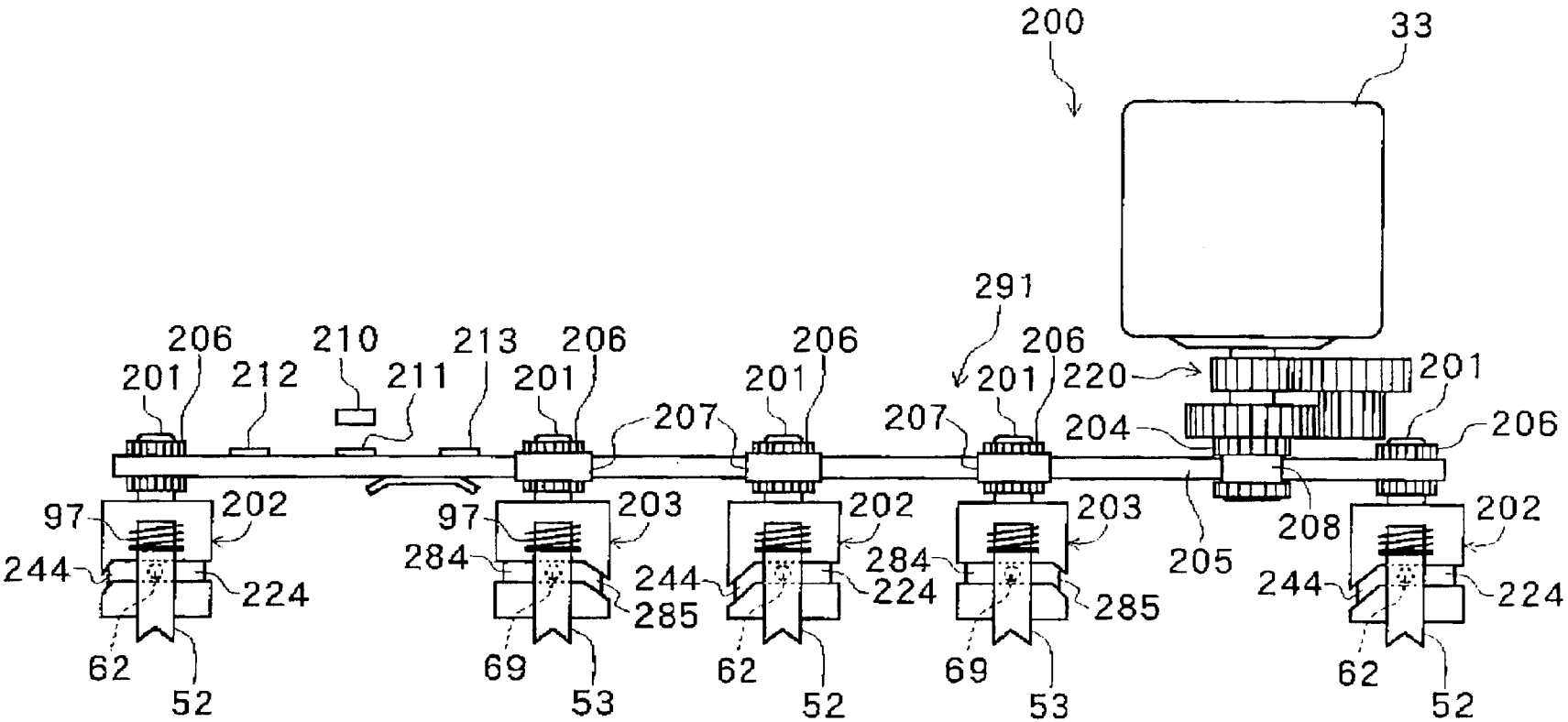
Figure 10:
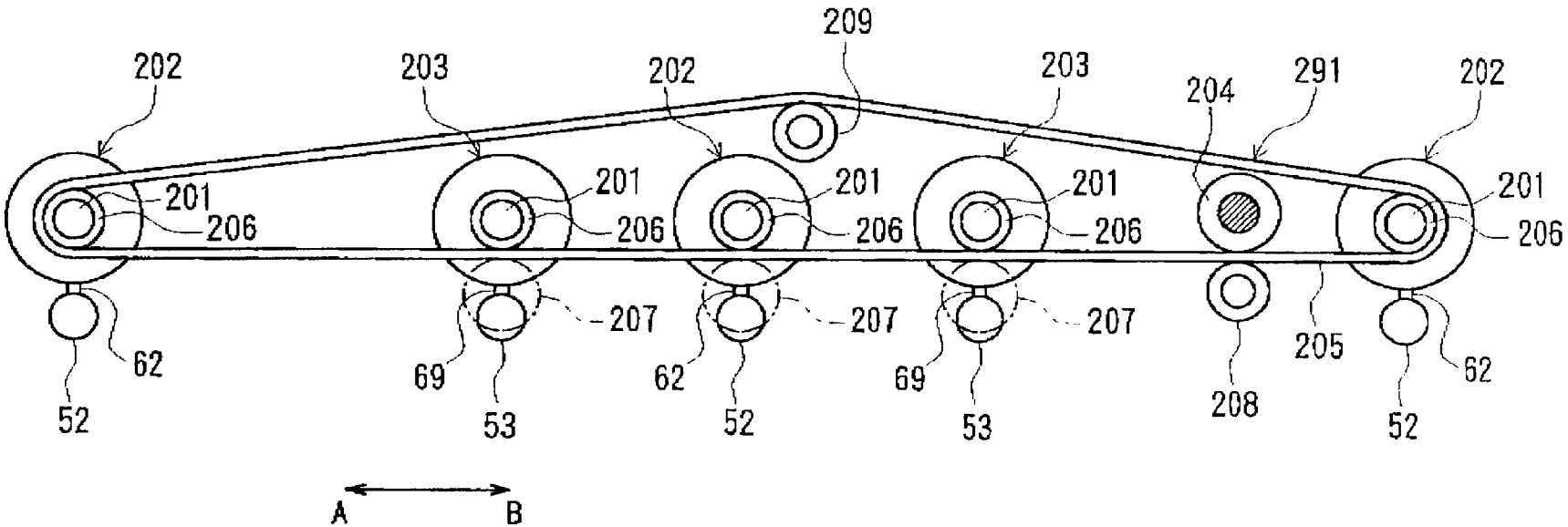
Figure 11:
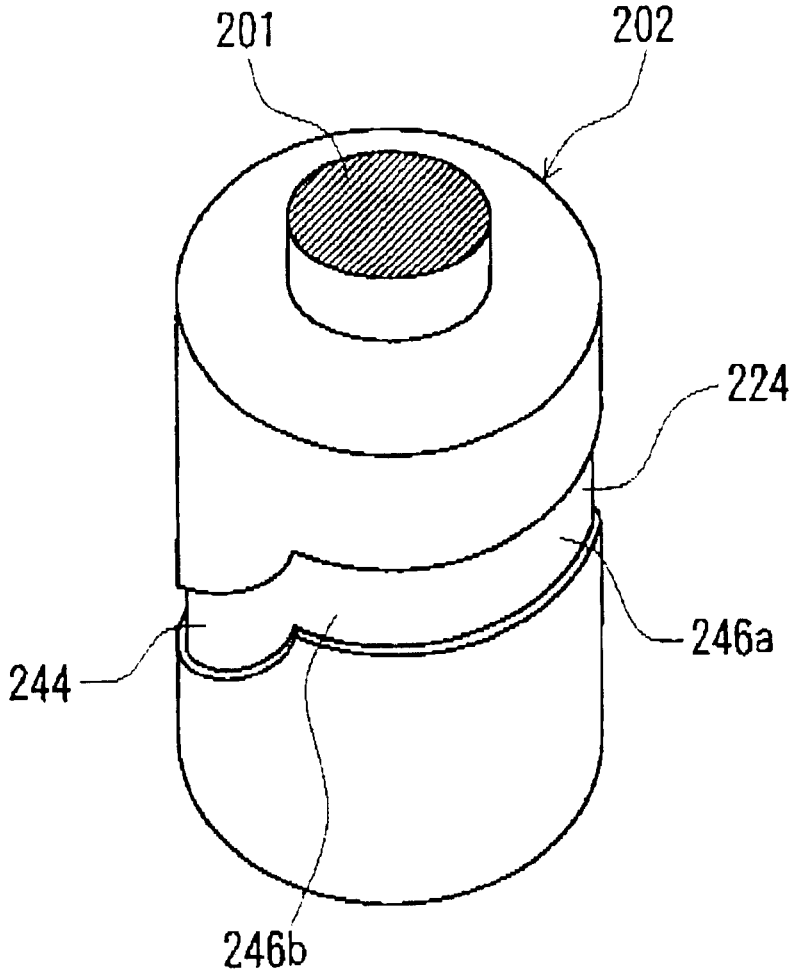
Figure 12:
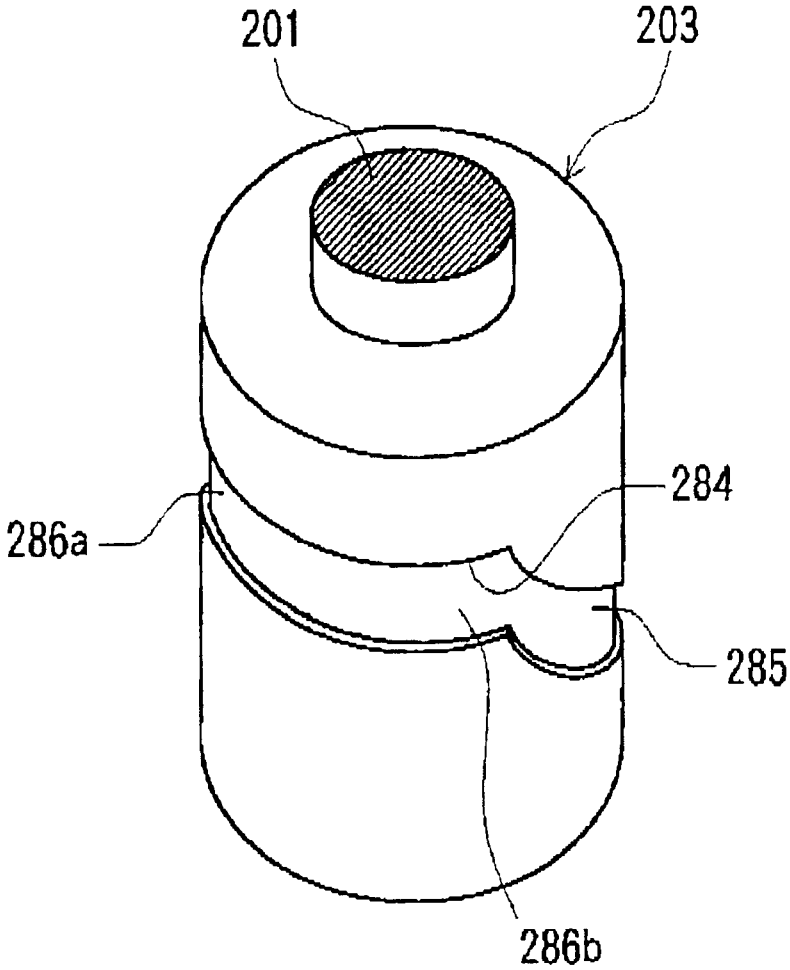

(a) is a view showing the state of punching out of a sheet by a punch of first group;

(b) is a view showing the state of finishing punching out of a sheet by the punch of the first group;

FIG. 6 is a view for explaining operations of the punch machine of the first embodiment;

(a) is a view showing the state of punching out of a sheet by a punch of second group;

(b) is a view showing the state of finishing punching out of a sheet by the punch of the second group;

FIG. 7 is a schematic front sectional view showing the punch machine of second embodiment;

FIG. 8 is a schematic view obliquely seen showing the punch machine of the second embodiment;

FIG. 9 is a schematic front view showing the punch machine of third embodiment;

FIG. 10 is a plane view of FIG. 9;

FIG. 11 is a view obliquely seen of rotating cam;

FIG. 12 is a view obliquely seen of rotating cam; and

Figure 13:
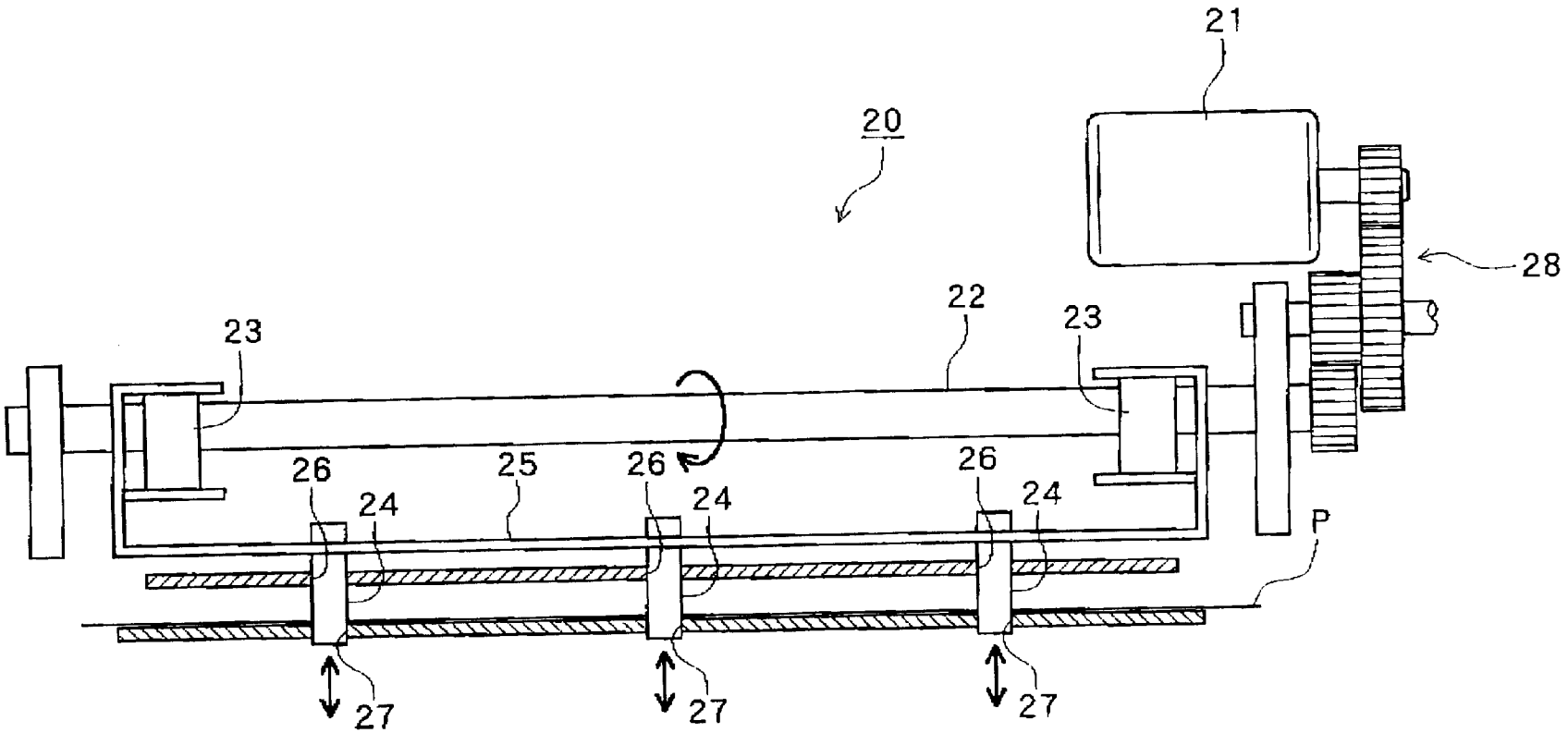
Fig.13 (PRIOR ART)

FIG. 13 is a schematic front view showing conventional punch machine.

DESCRIPTION OF THE PREFERRED EMBODIMENT

Punch machine of the embodiments of the present invention will now be explained on the basis of FIG. 1 through FIG. 12 hereinafter.

(First Embodiment)

Punch machine 30 of first embodiment will now be explained on the basis of FIG. 1 through FIG. 6.

The present invention may be embodied in other specific forms without departing from the spirit or essential attributes thereof and, accordingly, reference should be made to the appended claims, rather than to the foregoing specification, as indicating the scope of the invention.

(Explanation of Structure)

On a main body frame 31 of the punch machine 30, a motor 33 is provided through a bracket 32. The motor 33 is connected with a cam plate 35 formed by single plate member having strip shape through reducing gear mechanism 34, and is driving source for moving the cam plate 35 in right and left direction of FIG. 1.

The reducing gear mechanism 34 has a driving gear 37 provided with an output shaft 36 of the motor 33, an intermediate gear 38 having big diameter and an intermediate gear 39 having small diameter which are provided united with each other, a following gear 40 having bigger diameter than the intermediate gear 39 having small diameter, a pinion 41 provided united with the following gear 40, and a rack 42 formed on the cam plate 35, with which the pinion 41 engages.

The cam plate 35 is located so as to move along the inside of one side of the main body frame 31 having angular cylindrical shape. The cam plate 35 moves by transmitting the rotation of the pinion 41 to the rack 42. Five of convex portions 43 are formed on the upper and lower ends of the cam plate 35 such that contact area with the main body frame 31 is decreased and sliding resistance is decreased so as to smoothly move the cam plate 35. With the left end portion of the upper end of the cam plate 35, three notches 66, 67, 68 are provided, and a positioning plate 65 having elasticity, which is provided with the inside of the upper end of the main body frame 31, engages with one of these notches. The central notch 66 holds the cam plate 35 at the central position, the left side of the notch 67 holds the cam plate 35 on the right end, and the right side of the notch 68 holds the cam plate 35 at the left end. The positioning plate 65, the notches 66, 67, 68 comprises cam plate positioning mechanism 99 which is a holding means.

With the cam plate 35, four cams 44, 84, 94, 44 in the shape of slot are provided in order from the right. The cams 44, 84, 94, 44 have V-shape portions 95, 85, 95, 45 formed in V character shape, and first straight line portions 46, 86*a*, 96*a*, 46*a* and second straight line portions 46*b*, 86*b*, 96*b*, 46*b*, extending in the moving direction of the cam plate 35, in the direction away from the V-shape portions 95, 85, 95, 45 on both ends of the V-shape portions 95, 85, 95, 45. The length of the first straight line portions 46*a*, 86*a*, 96*a*, 46*a* is shorter than the length of the second straight line portions 46*b*, 86*b*, 96*b*, 46*b*. The first straight line portion 96*a* and the second straight line portion 86*b* communicate with each other. On this occasion, the cam slot of each of the cams 44, 84, 94, 44 is a through hole. But, the cam slot is not always a through hole.

Figure 1:
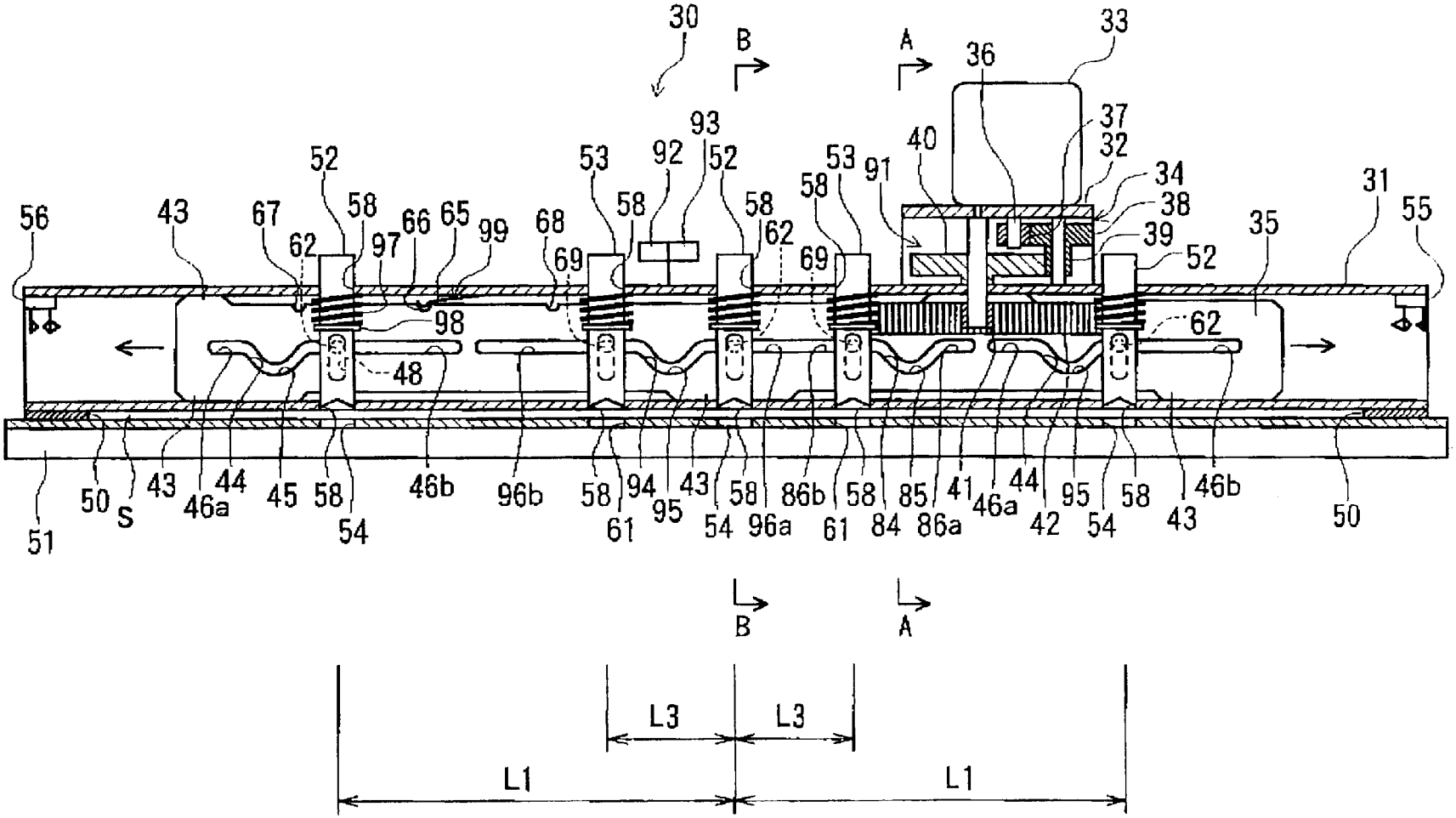
FIG. 1 is a front view showing punch machine of first embodiment of the present invention and is a view broken in a part.
Figure 2:
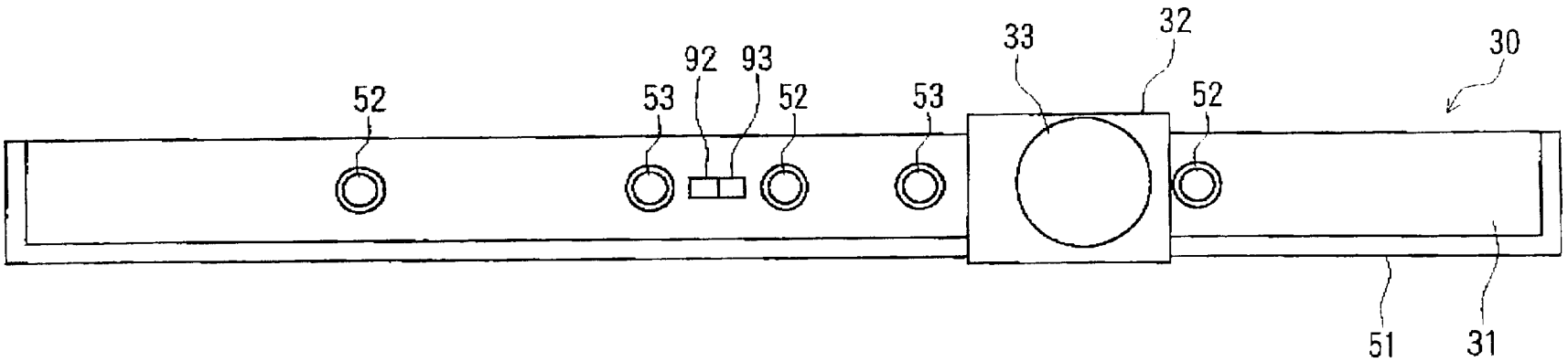
FIG. 2 is a plane view of FIG. 1.
Figure 3:
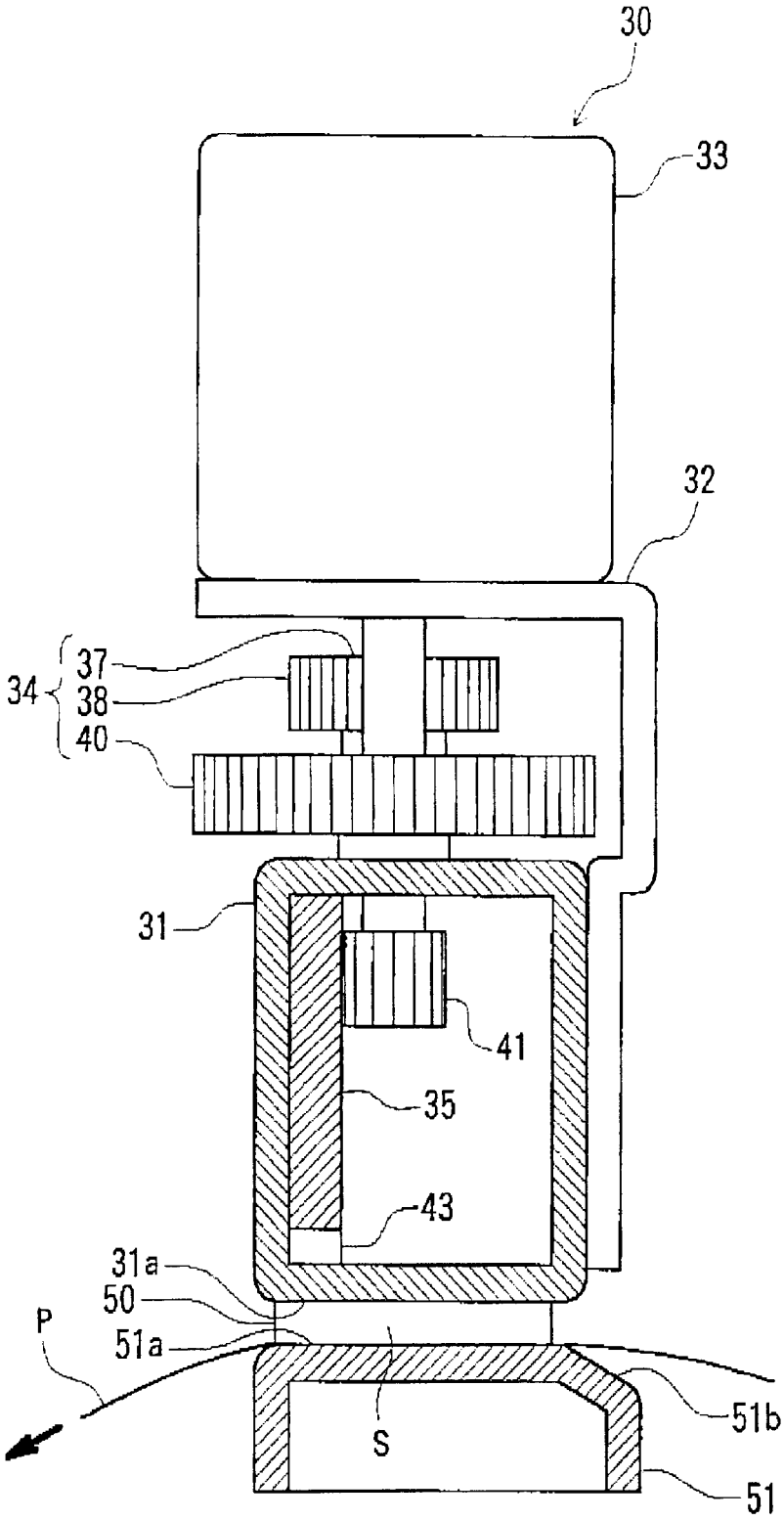
FIG. 3 is a sectional view seen from arrow A—A of FIG. 1.
Figure 4:
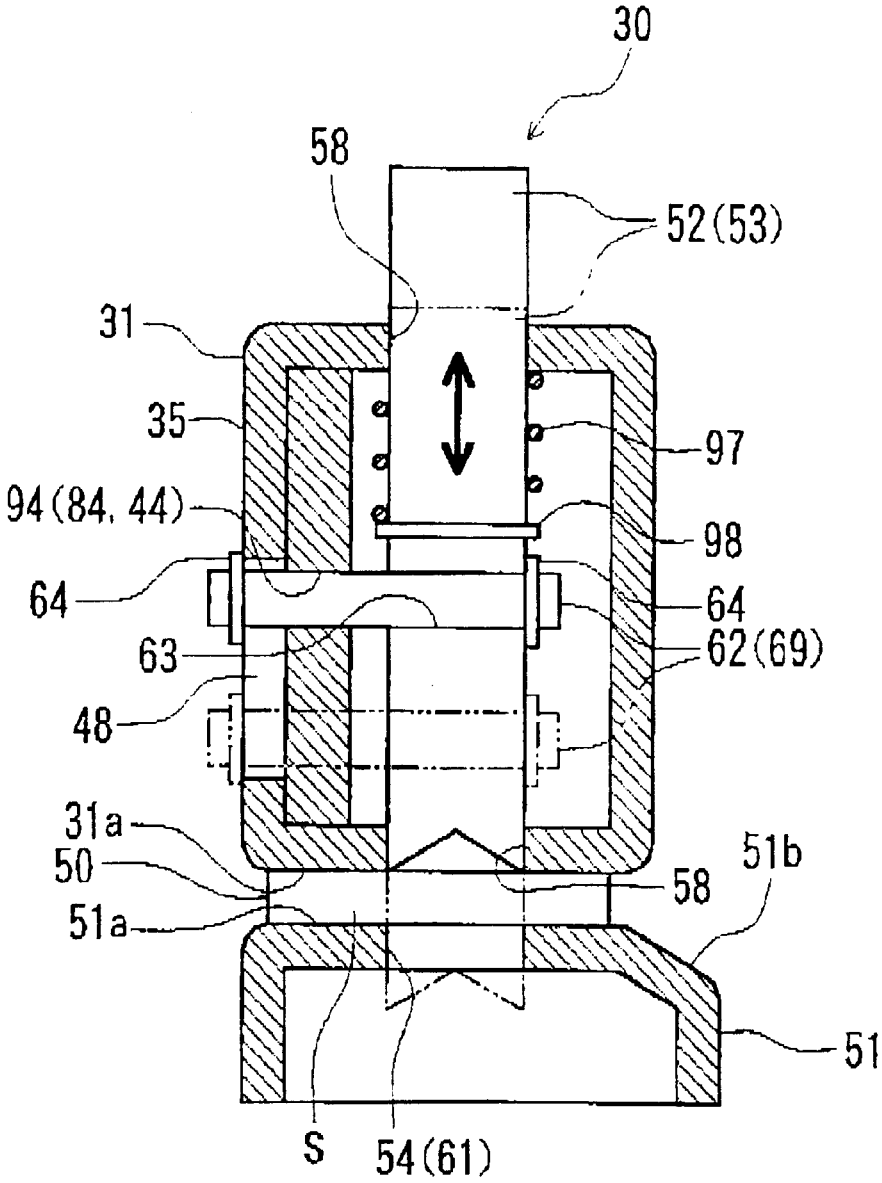
FIG. 4 is a sectional view seen from arrow B—B of FIG. 1.

In FIGS. 1, 3, 4, a leg 51 is attached to a lower face 31*a* of the main body frame 31 having spacers 50, 50 therebetween. The spacer 50 is provided for forming clearance S permitting passage of sheet P, which is material to be punched, between the lower face 31*a* of the main body frame 31 and an upper face 51*a* of the leg 51. In FIG. 3, an inclined face 51*b* for guiding a sheet in the clearance S is formed on the leg 51.

In FIG. 1, five of punches 52, 53, 52, 53, 52 having different pitch are provided with the main body frame 31 so as to move in up and down direction with a punch support hole 58 as its guidance. The three punches 52 are ones of first group for three holes for punching three holes out of a sheet, and are located at the equal pitch L1. The two punches 53 are ones of second group for two holes for punching two holes out of a sheet, and are located at the equal pitch L3 in the right and left direction from the central punch 52. On the leg 51, dies 54, 61, 54, 61, 54, penetrating the top end of the punches 52, 53, 52, 53, 52, are formed. And, the setting pitch L1 of the punches 52 of the first group is bigger than the setting pitch L2=2L3 of the punches 53 of the second group, and the setting pitches L1, L2 of the punches of both groups are set so as to make different from each other.

In FIG. 1 and FIG. 4, operating pins 62, 69 penetrating a through hole 63 of the punches 52, 53, the cams 94, 84, 44 and a guide hole 48 formed on the side wall of the main body frame 31, facing in the up and down direction, are provided with each of the punches 52, 53. On both ends of the operating pins 62, 69, retaining rings 64, 64 are attachably and detachably provided such that the operating pins 62, 69 do not drop out from the through hole 63 of the punches 52, 53.

A spring 97, for energizing the punches 52, 53 on the dies 54, 61 side, is provided with each of the punches 52, 53. The spring 97 is between the main body frame 31 and a retaining ring 98 provided with the punches 52, 53. Although the punches 52, 53 are energized on the lower hand by the spring 97, they are not dropped out from the main body frame 31 since the operating pins 62, 69 penetrate the cams 94, 84, 44 and they are received by the cams 94, 84, 44.

The cam 94 moves up and down both punches, punch 52 located third from and punch 53 located fourth from the right in FIG. 1. When the cam plate 35 is positioned at an intermediate position as shown in FIG. 1, the V-shape portions 45, 95, 45 of the cams 44, 94, 44 corresponding to the punch 52 of the first group are positioned on the left side of the punch 52, and the V-shape portions 95, 85 of the cams 94, 84 corresponding to the punch 53 of the second group are positioned on the right side of the punch 53.

Although the cams 44, 84, 94, 44 and the five sets of the punches 52, 53, 52, 53, 52 are provided with the main body frame 31 in order from the right side, the relative positional relation between the cam and the punch is different.

That is, in FIG. 1, the distance between each punch 52 of the three punches 52 for three holes and the V-shape portion 95, 95, 45 of the cam 44, 94, 44 facing each punch is set shorter in order from the right side punch 52. For this reason, the punches 52 go down in order, starting from the right side when the cam plate 35 is moved on the right-hand side of FIG. 1 so as to punch a hole out of a sheet with a time difference between punches.

In a similar way, the distance between the right side of the punch 53 of the two punches 53 for two holes and the V-shape portion 85 of the cam 84 is shorter than the distance between the left side of the punch 53 and the V-shape portion 95 of the cam 94. For this reason, the punches 53 go down in order, starting from the right side when the cam plate 35 is moved on the left-hand side of FIG. 1 so as to punch a hole out of a sheet with a time difference. In order to shift the timing of the punching operation of each of the punches 52, 53 on a sheet so as not to add the load on the motor 33 at one time, the relative positional relation of each set between the cams 44, 84, 94, 44 and the punches 52, 53, 52, 53, 52 is different from each other.

Cam plate detecting sensors 55, 56, for detecting the position of the cam plate 35, are provided with both ends of the bounds of lateral movement of the cam plate 35 of the main body frame 31. On the upper portion of the main body frame 31, punch detecting sensors 92, 93, for detecting the upper end of the central punches 52, 53, are provided.

The reducing gear mechanism 34, the cam plate 35 and the like of the above-mentioned structure comprises a driving means 91. The driving means 91 changes the rotating force of the motor 33 into linear reciprocating moving force, and transmits this force to the cam plate 35 such that the punches 52, 53 go up and down through the above-mentioned cam mechanism.

(Explanation of the Operations in Case of Punching Three Holes Out of a Sheet)

The positioning plate 65 of the cam plate positioning mechanism 99 engages with the central notch 66 and then, the cam plate 35 is generally held at the center of the main body frame 31, as shown in FIG. 1. At this time, the straight line portions 46*b*, 86*b*, 96*a*, 96*b*, 46*b* of the cams 44, 84, 94, 44 face the punches 52, 53, 52, 53, 52.

On the other hand, the motor 33 stops. When a sheet is fed in the clearance S between the main body frame 31 and the leg 51 and is positioned and stopped at a predetermined position, a sensor (not shown) detects the feeding of the sheet to the punch machine 30, and the punch machine 30 enters the operating state.

The motor 33 moves the cam plate 35 in the right direction. The cam plate 35 starts to move in the right direction, and the engagement position between the cams 44, 84, 94, 44 and the operating pins 62, 69, 62, 69, 62 of the respective punches 52, 53, 52, 53, 52 is changed.

Figure 5:
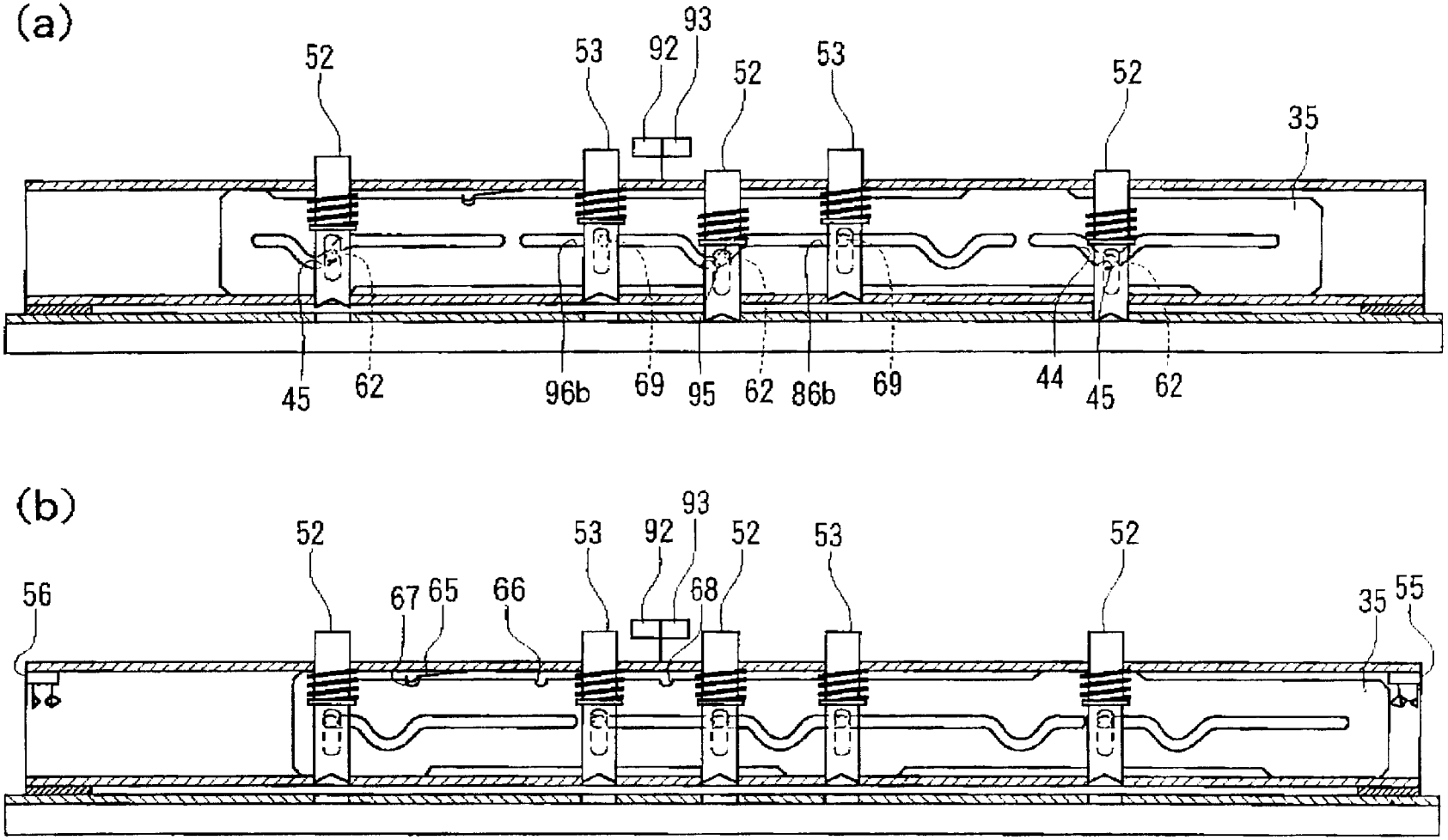
FIG. 5 is a view for explaining operations of the punch machine of the first embodiment.

In FIG. 5(*a*), the operating pin 62 of the punch 52 of the right edge is guided to the root of the V-shape portion 45 of the cam 44. For this reason, the right edge of the punch 52 goes down to the lowest descending position, and punches a hole out of a sheet, and the punch 52 is engaged with the die 54. On this occasion, the operating pin 62 of the central punch 52 is guided near the root of the V-shape portion 95 of the cam 94. For this reason, the central punch 52 does not go down to the lowest descending position just after the central punch 52 finishes punching a hole out of the sheet and enters in the die 54. During this, the punch detecting sensor 93 detects that the central punch 52 goes down, and the first group of the punch 52 is in operation. By doing so, it is confirmed that it is on the way of punching three holes out of the sheet.

And, the operating pin 62 of the punch 52 of the left edge is guided near the upper end of the V-shape portion 45 of the cam 44. For this reason, the left edge of the punch 52 does not yet enter in the die 54 before punching a hole out of the sheet. On the other hand, the operating pins 69, 69 of the punches 53, 53 of the second group are guided to the second straight line portions 86*b*, 96*b* and are held at the raising position.

Thereafter, the operating pin 62 of the central punch 52 and the operating pin 62 of the punch 52 of the left edge are guided to the root of the V-shape portions 95, 45 in order, and then the sheet is punched by the central punch 52 and the left edge of the punch 52 in order. During this time, the operating pins 69, 69 of the punches 53, 53 of the second group are guided to the second straight line portions 86*b*, 96*b* and are held at the raising position.

The cam plate 35 still moves in the right direction, and the respective cams 44, 94, 44 raise each punch 52, and the operating pins 62, 62, 62 are guided in the first straight line portion 46*a*, the second straight line portion 96*b* and the first straight line portion 46*a* so as to hold each punch 52 at the rising state. Lastly, as shown in FIG. 5(*b*), the cam plate 35 moves to the right utmost end, and the positioning plate 65 of the holding mechanism 99 engages with the notch 67 of the left end so as to hold the cam plate 35 at the right end. Then, it is prevented that the top end of the cams 44, 94, 44 abuts on the operating pins 62, 69, 62, and then the cam plate 35 springs out. During this time, the punch detecting sensor 93 detects the rise of the punch 52, and detects the finish of punching of three holes out of the sheet. And, the cam plate detecting sensor 55 is actuated by the cam plate 35, and detects that the cam plate 35 is positioned on the right edge so as to stop the motor 33. The sheet out of which the holes are punched is taken out of the clearance S (see FIG. 3), and a new sheet is fed to the clearance S.

When the motor 33 is reversed, the cam plate 35 moved to the right end is moved on the left side from the position of FIG. 5(*b*), and holes are punched out of the new sheet by the punches in order, starting from the left side of the punches 52. When the cam plate 35 returns to the position of FIG. 1, the positioning plate 65 engages with the notch 66 so as to hold the cam plate 35 at the central position.

(Explanation of the Operations in Case of Punching Two Holes Out of a Sheet)

The positioning plate 65 of the cam plate positioning mechanism 99 engages with the central notch 66 and then, the cam plate 35 is generally held at the center of the main body frame 31, as shown in FIG. 1. At this time, the straight line portions 46*b*, 86*b*, 96*a*, 96*b*, 46*b* of the cams 44, 84, 94, 44 face the punches 52, 53, 52, 53, 52.

On the other hand, the motor 33 stops. When a sheet is fed in the clearance S between the main body frame 31 and the leg 51 and is positioned and stopped at a predetermined position, a sensor (not shown) detects the feeding of the sheet to the punch machine 30, and the punch machine 30 enters the operating state.

The motor 33 moves the cam plate 35 in the left direction. The cam plate 35 starts to move in the left direction, and the engagement position between the cams 44, 84, 94, 44 and the operating pins 62, 69, 62, 69, 62 of the respective punches 52, 53, 52, 53, 52 is changed.

In FIG. 6(*a*), the operating pin 69 of the right punch 53 is guided to the root of the V-shape portion 85 of the cam 84. For this reason, the right punch 53 goes down to the lowest descending position, and a sheet is punched, and the punch 53 is engaged with the die 61. On this occasion, the operating pin 69 of the left punch 53 is guided near the root of the V-shape portion 95 of the cam 94. For this reason, the left punch 53 does not go down to the lowest descending position just after the left punch 52 finishes punching the sheet and enters in the die 54. During this time, the punch detecting sensor 92 detects that the left punch 53 goes down, and the second group of the punch 53 is in operation. By doing so, it is confirmed that it is on the way of punching two holes out of the sheet.

On the other hand, the operating pins 62, 62, 62 of the punches 52, 52, 52 of the first group are guided to the second straight line portions 46*b*, 86*b*, 46*b* and are held at the raising position.

The cam plate 35 is still moved in the left direction, and the cams 84, 94 raise the punches 53, 53 so as to receive the operating pins 69, 69 in the first straight line portions 86*a*, 96*a*. Then, the raising state of the punches 53, 53 is held.

Lastly, as shown in FIG. 6(*b*), the cam plate 35 moves to the left utmost end, and the positioning plate 65 of the holding mechanism 99 engages with the notch 68 of the right end so as to hold the cam plate 35 at the left end. Then, it is prevented that the top end of the cams 44, 84, 94, 44 abuts on the operating pins 62, 69, and then the cam plate 35 springs out. During this time, the punch detecting sensor 92 detects the rise of the punch 53, and detects the finish of punching of two holes out of the sheet. And, the cam plate detecting sensor 56 is actuated by the cam plate 35, and detects that the cam plate 35 is positioned on the left edge so as to stop the motor 33. The sheet out of which two holes are punched is taken out of the clearance S (see FIG. 3), and a new sheet is fed to the clearance S.

When the motor 33 is reversed, the cam plate 35 moved to the left end is moved on the right side from the position of FIG. 6(*b*), and holes are punched out of the new sheet by the punches in order, starting from the left side of the punches 53. When the cam plate 35 returns to the position of FIG. 1, the positioning plate 65 engages with the notch 66 so as to hold the cam plate 35 at the central position.

In this way, the punch machine 30 of the present invention can punch three holes out of a sheet when the cam plate 35 is moved on the right side rather than the intermediate position, and can punch two holes out of a sheet when the cam plate 35 is moved on the left side. So, different number of holes can be formed at different positions on a sheet with a single machine.

Besides, in the punch machine 30 of the present invention, the punches 52 (53) do not simultaneously punch out of a sheet, but holes are punched out of a sheet by punch 52 (53), starting from one end punch 52 (53) in order. Therefore, excess load is not added to the motor 33, and holes can be punched by even a small motor.

And, since the cam plate 35 is held at a predetermined position by the cam plate positioning mechanism 99, the punch does not make an error operation by spring out the cam plate 35 at the left or right end. Besides, the cam plate 35 holds all of the punches 52, 53 at the utmost rising position by the cam plate positioning mechanism 99 in FIG. 1 so as to certainly wait at a waiting position.

The spring 97, for energizing the punches 52, 53 in the direction approaching the dies 54, 61, is provided with the punches 52, 53. This spring 97 reduces the load when the punches 52, 53 punch a hole out of a sheet, and serves as load when the cam plate 35 keeps the punches 52, 53 away from the dies 54, 61. Then, the load adding to the motor 33 can be made almost equal when the cam plate 35 is moved, and the motor 33 smoothly rotates and the punch machine 30 can continuously punch out of a sheet.

The cam 94 in the first embodiment is used for both punches 53 and 52. But, the cam 94 may be separately provided with each punch 53 or 52 without using for both when the arrangement interval between the punches 53 and 52 is wide.

In the punch machine 30 of the first embodiment, the operating pin is provided with the punches 52, 53 and the cams 44, 94, 84 of V-character shape are provided with the cam plate 35. But, cams of reverse V shape may be provided with the punch, and operating pins may be provided with the cam plate.

[Second Embodiment]

Punch machine 130 of second embodiment will now be explained on the basis of FIG. 7 and FIG. 8.

(Explanation of Structure)

In the punch machine 130 of the second embodiment, the operating pin 62 is provided with the central punch 52 so as to project, and cam plates 172, 173, 173, 172 are provided with the other punches 52, 53, 53, 52, and a cam 144 with which the operating pin 62 engages and operating pins 162, 169, 169, 162 for engaging with the cam plates 172, 173, 173, 172 are provided with a movable plate 135. On this occasion, concerning the same portions as the first embodiment, the same marks are affixed and the explanation thereof is omitted.

The cam 144 has a V-shape portion 145 formed in V character shape, and a first straight line portion 146*a* and a second straight line portion 146*b*, which are connected with both ends of the V-shape portion 145, extending in the direction keeping away from the V-shape portion 145 and in the moving direction of the movable plate 135.

Cams 174, 184, formed on the cam plates 172, 173, has reverse V shape portions 175, 185 formed in reverse V character shape, and first straight line portions 176*a*, 186*a* and second straight line portions 176*b*, 186*b*, which are connected with both ends of the reverse V shape portions 175, 185, extending in the direction keeping away from the reverse V shape portions 175, 185 and in the moving direction of the movable plate 135.

The length of the first straight line portions 146*a*, 176*a*, 186*a* is shorter than that of the second straight line portions 146*b*, 176*b*, 186*b*. The three punches 52 are ones for three holes, belonging to the first group for punching three holes out of a sheet, and are located at equal intervals of L1. The two punches 53 are ones for two holes, belonging to the second group for punching two holes out of a sheet, and are located at equal intervals of L3 from the central punch 52 in the right and left direction. Furthermore, the cam 144 and the cam 174 corresponding to the punch 52 of the first group are formed with point symmetry. Similar to the first embodiment, the relative positional relation between the cams 174, 184, 144, 184, 174 and the pins 162, 169, 62, 169, 162, engaging with each other, is different from each other in order to shift punching timing of each of the punches 52, 53 so as to reduce the sheet punching load.

On this occasion, the respective cams 144, 174, 184 are through holes, but may be cam slots each having a bottom.

Of the above-mentioned structure, a reducing gear mechanism (not shown), the movable plate 135 and the like comprise a driving means 191. The driving means 191 changes the rotating force of the motor 33 into linear reciprocating motion force, and transmits this force to the movable body 135 such that the punches 52, 53 go up and down.

(Operations in Case of Punching Three Holes Out of a Sheet)

As shown in FIG. 7, the movable plate 135 is held at the center of the main body frame 31 by engaging a positioning plate 165 having the elasticity of an operating plate positioning mechanism 199 (see FIG. 8) with a central notch 167. At this time, the second straight line portions 176*b*, 186*b*, 146*b*, 186*b*, 176*b* of the cams 174, 184, 144, 184, 174 are engaged with the operating pins 162, 169, 62, 169, 162.

When the movable plate 135 is moved in the left direction, the pin 162 is engaged with the reverse V shape portion 175, and the V-shape portion 145 is engaged with the pin 62. Since the relative positional relation between the cams 174, 144, 174 and the pins 162, 62, 162, engaging with each other, is different from each other, the punches 52 descend with time difference, and punch three holes out of a sheet, starting from the right side punch 52 in order, in FIG. 7 and FIG. 8. And, the three punches 52 receive the elastic force of the spring 97, and descend. By doing so, the load when punching holes out of a sheet is reduced.

When the movable plate 135 is moved in the utmost left side, the positioning plate 165 is engaged with a notch 168, and the movable plate 135 is held at the utmost left position. By doing so, the movable plate 135 can be waiting at the left waiting position.

When the movable plate 135 is returned to the center position from the left end, the punches 53 newly punch three holes out of a sheet during this movement.

(Operations in Case of Punching Two Holes Out of a Sheet)

When the movable plate 135 is moved in the right direction from the position of FIG. 7, the pin 169 is engaged with the reverse V shape portion 185. Since the relative positional relation between the cams 184, 184 and the pins 169, 169, engaging with each other, is different from each other, the punches 53 descend with time difference, and punch two holes out of a sheet, starting from the right side punch 53 in order, in FIG. 7 and FIG. 8. And, the two punches 53 receive the elastic force of the spring 97, and descend. For this reason, the load when punching holes out of a sheet is reduced.

When the movable plate 135 is moved in the utmost right direction, the positioning plate 165 is engaged with a notch 166, and the movable plate 135 is held at the utmost right position. By doing so, the movable plate 135 can be certainly waited at the right waiting position. When the movable plate 135 is returned to the center position from the right end, the punch 52 newly punches two holes out of a sheet during this movement.

As mentioned before, in the sheet punch machine 130 of the second embodiment also, the three punches 52 of the first group can punch three holes out of a sheet when the movable plate 135 is moved on the left side rather than the intermediate position, and two punches 53 of the second group can punch two holes out of a sheet when the movable plate 135 is moved on the right side. So, different number of holes can be punched at different positions on a sheet with a single machine.

[Third Embodiment]

Punch machine 200 of a third embodiment will now be explained on the basis of FIG. 9 through FIG. 12.

(Explanation of Structure)

In a structure of the punch machine 200 of the third embodiment, rotating cams 202, 203, rotatable with a shaft 201 parallel to going up and down direction of the punches 52, 53 as its center, are respectively provided so as to face the respective punches 52, 53 in place of the cam plate 35 of the first embodiment. An operating gear 206 is provided with the shaft 201 of the respective rotating cams 202, 203.

Each operating gear 206 engages with a toothed belt 205 for engaging with a following gear 204 of a reducing gear mechanism 220 for reducing the rotational number of the motor 33. As shown in FIG. 10, the toothed belt 205 is formed in the shape of closed ring, and is provided being free to reciprocate in the direction as shown by the arrows A and B for predetermined distance bounds by the motor 33. Since the punches 52, 53 are arranged in the shape of a straight line, the rotating cams 202, 203 should be also arranged in a straight line.

For this reason, the intermediate three operating gears 206 engage with the straight line portion of the toothed belt 205 in FIG. 10. And, the following gear 204 also engages with the straight line portion. But, the straight line portion of the toothed belt 205 is easy to separate from the intermediate three operating gears 206 and the following gear 204. For this reason, the straight line portion of the toothed belt 205 does not separate by pushing the toothed belt 205 toward the operating gears 206 and the following gear 204 by three pushing rollers 207 and a pushing roller 208. And, the one side portion of the toothed belt 205 escapes by an idle gear 209 so as not to engage with the operating gears 206 and the following gear 204.

In FIG. 11 and FIG. 12, cams 224, 284, similar to the cam plate 35 of the first embodiment, are formed on the rotating cams 202, 203 as cam cylinders. These cams 224, 284 also have V shape portions 244, 285 formed in V character shape, and first straight line portions 246*a*, 286*a* and second straight portions 246*b*, 286*b* connecting with each other, extending in the direction keeping away from the V shape portions 244, 285 and in the moving direction of the toothed belt 205. The operating pin 62 of the punch 52 is engaged with the cam 224, and the operating pin 69 of the punch 53 is engaged with the cam 284.

In FIG. 9, the V shape portion 244 of each cam 224 corresponding to the three punches 52 of the first group is positioned on the left side of the punch 52, and the V shape portion 285 of each cam 284 corresponding to the two punches 53 of the second group is positioned on the right side of the punch 53.

Of the above-mentioned structure, the reducing gear mechanism 220, the toothed belt 205 and the rotating cams 202, 203 as cam cylinders and the like comprise a driving means 291. The driving means 291 changes the rotating force of the motor 33 into straight line movement, and transmits the rotating force of the motor 33 to the rotating cams.

(Explanation of the Operations in Case of Punching Three Holes Out of a Sheet)

When the motor is started to drive and the toothed belt 205 is rotated in the left direction (in the arrow B direction) in FIG. 10, the rotating cams 202, 203 are also rotated in the left direction. By engagement between the V shape portion 244 of the cam 224 of the rotating cam 202 and the operating pin 62, the punch 52 descends. But, the cam 284 of the rotating cam 203 engages with the operating pin 69 of the punch 53 in the second straight line portion 286*b* portion. For this reason, the punch 53 does not descend, and is held at the rising position.

Also, in this punch machine 200 the relative positional relation between the respective cams 224, 284 and the respective punches 52, 53 is different from each other. So, each punch 52 does not simultaneously punch holes out of a sheet, and three holes are punched in order so as not to add excess load on the motor 33. The left rotation of the toothed belt 205 stops by detecting a striker 212 on the toothed belt 205 by a sensor 210 (see FIG. 9) and stopping the motor 33. Thereafter, the toothed belt 205 is reversely rotated and the toothed belt 205 is rotated until the sensor 210 detects a striker 211. At this time, the punch 52 descends so as to punch three holes out of a new sheet.

(Explanation of the Operations in Case of Punching Two Holes Out of a Sheet)

When the toothed belt 205 is rotated in the right direction (in the arrow A direction) from the state of FIG. 10, the rotating cam 203 lets the punches 53 descend in order. The punches 53 descend in order, and ascend so as to punch two holes out of a sheet. When the sensor 210 detects a striker 213, the motor 33 and the toothed belt 205 stop. Thereafter, the toothed belt 205 is reversely rotated and the toothed belt 205 is rotated until the sensor 210 detects a striker 211. At this time, the punches 53 descend and ascend so as to punch two holes out of a sheet.

The punches 52, 53 of the punch machine 200 of the third embodiment also punch a hole out of a sheet by being pushed by the spring 97 when descending. For this reason, excess load is not added to the motor when punching a sheet.

In the above-mentioned respective embodiments, the three punches 52 belong to the first group, and the two punches 53 belong to the second group. But, the two punches 53 may belong to the first group, and the three punches 52 may belong to the second group.

On this occasion, a sheet is paper, thin resin one, substituting for paper, thick paper or the like. But, the material to be punched is not limited to a sheet since the punch machine of the present invention can punch a hole out of a thin metal plate except for a sheet.

As such, the cam mechanism is not limited to the cam slots and the cam-follower such as the pins 62, 69 engaging with the cam slots, and any structure of the cam mechanism may be adopted as long as the reciprocating motion of the driving means can be transmitted to the reciprocating straight line motion of the punch. This reciprocating motion includes the case where as shown in the third embodiment, the toothed belt 205 comprising the driving means reciprocates in the predetermined bounds on the locus, in the shape of a loop or in the predetermined bounds on the locus in the shape of a circumference in positive or negative direction in addition to the case where the cam plate 35 and the movable plate 135 comprising the driving means linearly reciprocate as shown in the first and second embodiments.

What is claimed is:

1. Punch machine, comprising:

a plurality of punches and dies for punching holes out of material to be punched;

driving means for reciprocating in first and second direction intersecting with respect to said punches by driving force of driving source;

a cam mechanism for changing reciprocating motion of said driving means into direction moving said punch and transmitting it to said punch, provided between said each punch and said driving means;

said plurality of punches divided in a first group and a second group;

said cam mechanism provided between each punch of said first group and said driving means, for moving said each punch by movement operation of said driving means in said first direction; and said cam mechanism provided between each punch of said second group and said driving means, for moving said each punch by movement operation of said driving means in said second direction.

2. The punch machine as set forth in claim 1, wherein said cam mechanism has a cam slot and a cam-follower engaging with said cam slot.

3. The punch machine as set forth in claim 1, wherein energizing means for energizing said punch in a direction approaching said material to be punched is provided with said punch.

4. The punch machine as set forth in claim 1, wherein said cam mechanism is comprised so as to operate such that each punch moves with predetermined phase difference among said punches comprising each group.

5. The punch machine as set forth in claim 2, wherein said driving means has a plate member provided being free to reciprocate and drive by said driving source, and said cam slot is formed on said plate member, and said cam follower is provided with said punch.

6. The punch machine as set forth in claim 1, wherein said cam mechanism is to be used for two or more punches.

7. The punch machine as set forth in claim 6, wherein said cam mechanism has a cam slot, said cam mechanism engaging with a plurality of said cam-followers.

8. The punch machine as set forth in claim 1, wherein means for holding said driving means is provided with said driving means so as to be free to hold said driving means at a predetermined position of said reciprocating motion.

9. The punch machine as set forth in claim 1, wherein a number of said punches belonging to said first group and a number of said punches belonging to said second group are different from each other.

10. The punch machine as set forth in claim 1, wherein said punches belonging to said first group are a plural number, said punches belonging to said second group are a plural number, and arrangement pitch of said punches belonging to said first group and arrangement pitch of said punches belonging to said second group are different from each other.

* * * * *